US011746524B2

(12) United States Patent
Narbutas

(10) Patent No.: US 11,746,524 B2
(45) Date of Patent: Sep. 5, 2023

(54) PORTABLE AND REMOVABLE WALL MODULES FOR RESIDENTIAL LIVING SPACE

(71) Applicant: Tomas Narbutas, Vista, CA (US)

(72) Inventor: Tomas Narbutas, Vista, CA (US)

( * ) Notice: Subject to any disclaimer, the term of this patent is extended or adjusted under 35 U.S.C. 154(b) by 0 days.

(21) Appl. No.: 17/491,264

(22) Filed: Sep. 30, 2021

(65) Prior Publication Data

US 2023/0095252 A1 Mar. 30, 2023

(51) Int. Cl.
*E04B 2/82* (2006.01)
*E04B 2/78* (2006.01)
*E04B 2/74* (2006.01)

(52) U.S. Cl.
CPC ..... *E04B 2/821* (2013.01); *E04B 2/789* (2013.01); *E04B 2002/7477* (2013.01)

(58) Field of Classification Search
CPC .. E04B 2/789; E04B 2/821; E04B 2002/7477; E04B 2/7403; E04B 2/7429; E04B 2/824
See application file for complete search history.

(56) References Cited

U.S. PATENT DOCUMENTS 2,365,255 A * 12/1944 Eager ..... E04B 2/821 52/468
2,443,548 A * 6/1948 Wilson ..... E04B 2/822 52/217
2,855,037 A * 10/1958 Stiffel ..... E04B 2/7438 15/268
2,886,147 A * 5/1959 Paukstela ..... E04B 2/821 52/143
3,072,975 A * 1/1963 Burmeister ..... E06B 7/21 105/155
3,180,457 A * 4/1965 Bohnsack ..... E04B 2/7854 52/287.1
3,256,668 A * 6/1966 Downes ..... E04B 2/789 52/769
3,288,418 A * 11/1966 Hinrichs ..... E04B 2/824 52/632
3,331,426 A * 7/1967 Ensign ..... E06B 3/928 160/199
3,335,532 A * 8/1967 Greenbie ..... E04B 2/821 52/143

(Continued)

*Primary Examiner* — James M Ference
(74) *Attorney, Agent, or Firm* — DLA Piper LLP (US)

(57) ABSTRACT

Portable and removable wall modules for residential living space are disclosed. The modules create a sound dampening or near-soundproof division of the living space. The modules comprise one or more u-channel bars that attach to the ceiling and wall and one or more adjustable baseboards that sit on the floor. The adjustable active baseboards each comprise a spring-loaded platform that pushes the wall panels upward against the top interior of the u-channel bars and ceiling to create a vertically-sealed division of the living space. The product can be used for all ages and uses; splitting a room for two children, young adults in dormitories or apartments, creating a hard wall that looks good. It provides costs savings avoiding having to move and lease larger spaces, especially in high costs and dense urban housing markets. The product is easy to install, remove and is reusable. It can be relocated when moving from one dwelling to another and it adjusts to differing ceiling heights and room sizes of dwellings.

18 Claims, 8 Drawing Sheets

(56) References Cited

U.S. PATENT DOCUMENTS 3,386,216 A * 6/1968 Zwickert ..... E04B 2/821 49/504
3,453,789 A * 7/1969 Stephenson ..... E04B 2/822 52/241
3,453,790 A * 7/1969 Harris ..... E04B 2/821 52/DIG. 1
3,638,376 A * 2/1972 Howes ..... E04B 2/824 52/109
3,699,734 A * 10/1972 Craig ..... E04B 2/82 52/127.6
3,834,092 A * 9/1974 Whisson ..... E04B 2/74 52/36.4
3,885,361 A * 5/1975 De Schutter ..... E04B 2/78 52/242
3,897,668 A * 8/1975 McDonnell ..... E04B 2/822 248/200.1
3,967,420 A * 7/1976 Papsco ..... E04F 21/1894 52/745.1
3,984,949 A * 10/1976 Wahlquist ..... E04B 1/3445 52/143
4,037,380 A * 7/1977 Pollock ..... E04B 2/824 52/475.1
4,086,734 A * 5/1978 Hayashi ..... E04B 2/821 52/243.1
4,103,463 A * 8/1978 Dixon ..... E05D 15/0613 52/143
4,129,163 A * 12/1978 Johnson ..... E04B 2/7427 52/239
4,161,850 A * 7/1979 Peterson ..... E04B 2/82 52/239
4,188,758 A * 2/1980 Swann ..... E04B 2/824 52/241
4,277,920 A * 7/1981 Dixon ..... E05D 15/0613 52/64
4,448,231 A * 5/1984 Salkeld ..... E04B 2/7427 16/268
4,450,658 A * 5/1984 Legeai ..... E04B 2/7409 52/240
4,454,690 A * 6/1984 Dixon ..... E04B 2/824 52/126.3
4,535,578 A * 8/1985 Gerken ..... E06B 7/16 49/320
4,641,479 A * 2/1987 Spurlock ..... E04C 2/40 52/64
4,708,189 A * 11/1987 Ward ..... E04G 21/243 160/351
4,713,920 A * 12/1987 Oginz ..... E04B 2/825 52/584.1
4,722,146 A * 2/1988 Kemeny ..... E04B 2/7429 52/800.11
5,010,943 A * 4/1991 Boyer ..... B60P 3/205 160/351
5,038,534 A * 8/1991 Pollock ..... E04B 2/7451 52/241
5,042,555 A * 8/1991 Owens ..... E04B 2/827 160/40
5,159,793 A * 11/1992 Deugo ..... E04B 2/82 52/243.1
5,228,254 A * 7/1993 Honeycutt, Jr. ..... E04B 2/7407 52/468
5,237,786 A * 8/1993 Kochansky ..... E04B 2/824 52/242
5,259,164 A * 11/1993 Wiese ..... E04H 1/1272 52/578
5,377,467 A * 1/1995 Barnavol ..... E04B 2/825 D25/199
5,471,791 A * 12/1995 Keller ..... E04B 2/827 160/40
5,471,805 A * 12/1995 Becker ..... E04B 2/7411 52/241
5,524,402 A * 6/1996 Sykes ..... E04B 2/82 52/241
5,655,344 A * 8/1997 Moen ..... E04B 2/789 52/690
5,845,363 A * 12/1998 Brempell ..... E05D 15/0669 16/99
6,058,665 A * 5/2000 Halvorson, Jr. ..... E06B 1/524 49/260
6,267,525 B1 * 7/2001 Wu ..... A47G 5/00 403/174
7,814,711 B2 * 10/2010 Milligan ..... E04B 2/7401 52/220.1
8,167,152 B1 * 5/2012 Gatti ..... E04B 2/821 211/187
8,601,749 B2 * 12/2013 Von Hoyningen Huene ..... E04C 2/46 52/126.6
8,819,994 B2 * 9/2014 Ingram ..... E04B 2/827 49/128
9,206,600 B2 * 12/2015 Von Hoyningen Huene ..... E04B 2/7401
10,041,249 B1 * 8/2018 Hebert ..... E04G 21/243
10,196,813 B2 * 2/2019 Conybeare ..... E04B 1/6183
10,501,933 B2 * 12/2019 Stroyer ..... E04B 2/7836
2005/0081472 A1 * 4/2005 Moore ..... A47B 96/1425 52/633
2005/0210798 A1 * 9/2005 Burg ..... E04B 2/7457 52/481.1
2006/0000670 A1 * 1/2006 Dodd ..... E04B 2/7409 181/290
2006/0179788 A1 * 8/2006 Nicoletti ..... E04B 2/7455 52/741.15
2008/0209827 A1 * 9/2008 Webb ..... E04B 2/821 52/220.7
2009/0000750 A1 * 1/2009 Hardt, II ..... E04B 2/7427 160/351
2009/0307990 A1 * 12/2009 Muehlebach ..... E04B 2/822 52/63
2013/0186023 A1 * 7/2013 Nobile ..... E04B 2/7427 52/745.11
2015/0233114 A1 * 8/2015 Hoefler ..... E04B 2/7433 52/239
2015/0361659 A1 * 12/2015 Sessler ..... E04B 2/16 52/483.1
2017/0314261 A1 * 11/2017 Kopish ..... E04C 2/46
2018/0058066 A1 * 3/2018 Yamazoe ..... E04B 1/8209
2021/0140172 A1 * 5/2021 Pylypczak ..... E04B 2/7401
2023/0095252 A1 * 3/2023 Narbutas ..... E04B 2/7403 52/238.1

* cited by examiner

PORTABLE AND REMOVABLE WALL MODULES FOR RESIDENTIAL LIVING SPACE

FIELD OF THE INVENTION

Portable and removable wall modules for residential living space are disclosed. The modules create a sound dampening or near-soundproof division of the living space. The modules are easy to install and remove by an ordinary consumer.

BACKGROUND OF THE INVENTION

As urban living areas become denser with increasing housing costs, housing shortage in urban areas and college towns and lower income housing needs, it is increasingly important to be able to live comfortably with more people in the same space. When multiple people share the same living space, achieving privacy and creating separate "spaces" is a challenge. The need for separate spaces has been made more urgent in light of the current desire to minimize the transmission of airborne viruses such as COVID-19, particularly in shared college dormitories or bedrooms.

One prior art technique for dividing a residential living space is to install a permanent wall to divide the room. This typically involves installing a wooden frame and permanently attaching it to other permanent walls and adding insulation and drywall to the wooden frame and may require obtaining city permits. The wall is permanently affixed to other walls or beams and cannot be easily removed by an ordinary consumer without causing structural damage to other parts of the house or leased dwelling.

A less permanent prior art technique is to add a temporary room divider, which can be as simple as a curtain (which is commonly used to divide hospital rooms) or can involve a solid divider on wheels that provides a partial but not complete division of the space. For instance, there typically are gaps above or below the divider, which minimizes the effectiveness of the divider for privacy and sound dampening purposes and virus transmission. These prior art temporary room dividers are extremely limited in their ability to provide a feeling of privacy for users.

What is needed is an improved mechanism for dividing a residential living space into two or more parts, where the mechanism is portable and removable. What is further needed is a mechanism that is sound dampening or near-soundproof and that creates a seal vertically (e.g., from floor to ceiling) and/or horizontally (e.g., from one permanent wall to another). What is further needed is a mechanism that is easy to install and remove by an ordinary consumer and does not require the services of a contractor and is reusable when moving from one dwelling to another.

SUMMARY OF THE INVENTION

Portable and removable wall modules for residential living space are disclosed. The modules create a sound dampening or near-soundproof division of the living space. The modules comprise one or more u-channel bars that attach to the ceiling and wall and one or more adjustable baseboards that sit on the floor. The adjustable active baseboards each comprise a spring-loaded platform that pushes the wall panels up against the top interior of the u-channel bars to create a vertically-sealed division of the living space. The active baseboard allows for adjustment to differing ceiling heights and is adaptable to many different dwellings. Different room configurations using the modules are disclosed herein.

DETAILED DESCRIPTION OF THE INVENTION

Figure 1:
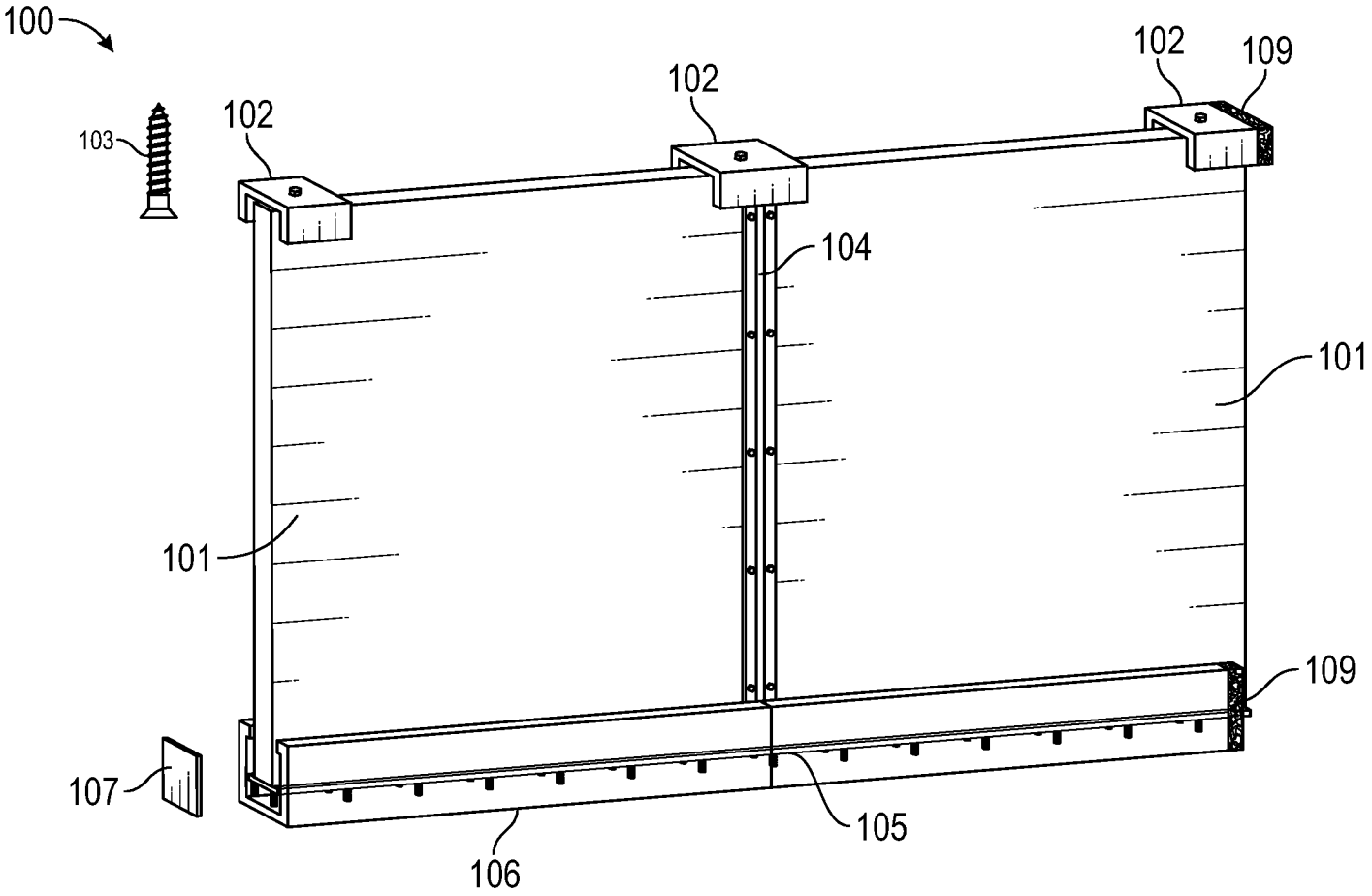
FIG. 1 depicts an embodiment of a straight wall module. (Elevation view)

FIG. 1 depicts a side-view (elevation) of straight module 100. Straight module 100 comprises acoustic panels 101, u-channel bars 102, attachment mechanism 103, hinge 104, foam gasket 109, and adjustable baseboard 105. Adjustable baseboard 105 comprises spring-loaded level 106 and cover plate 107 and non-skid material 111.

Each acoustic panel 101 is constructed from material that is sound dampening or near-soundproof. In one embodiment, acoustic panel 101 comprises a highly compacted polyester material that provides a rigid structure but is soft to the touch.

U-channel bar 102 is constructed from metal, plastic, or another rigid material. It attaches to the ceiling and wall of the living space through attachment mechanism 103 and receives one or more acoustic panels 101 in its channel area. Optionally the acoustic panels are affixed to attachment mechanism 103 with screws, bolts, or other mechanisms.

Attachment mechanism 103 secures u-channel bar 102 to the ceiling and wall. Attachment mechanism 103 can comprise screws, drywall screws, nails, staples, adhesive, or other mechanisms. Foam gasket 109 is constructed from a compressionable material is placed between U-channel bar 102 and the permanent wall.

Hinge 104 is constructed from metal, plastic, or another rigid material. It connects to two acoustic panels 101 and allows the panels to pivot. In straight module 100, the panels likely will not need to pivot and will be held parallel by u-channel bar 102. The hinge is a rigid molded plastic, connecting two adjacent panels. It has flexible grooves running lengthwise which allow the panels to continue in a straight line or to move at various angles; such as 90 degrees for the corner unit 200 or 180 degrees for shipping and storage purposes.

Adjustable baseboard 105 sits on the floor of the living space and receives the bottom edge of acoustic panels 101. Spring-loaded level 106 presses acoustic panels upward against the top interior surface of u-channel bar 102. In this manner, straight module 100 provides a vertically-sealed space that fills the entire vertical space between ceiling and floor. The bottom of the baseboard has a non-skid material 111 to prevent movement on hard flooring or carpets.

Figure 2:
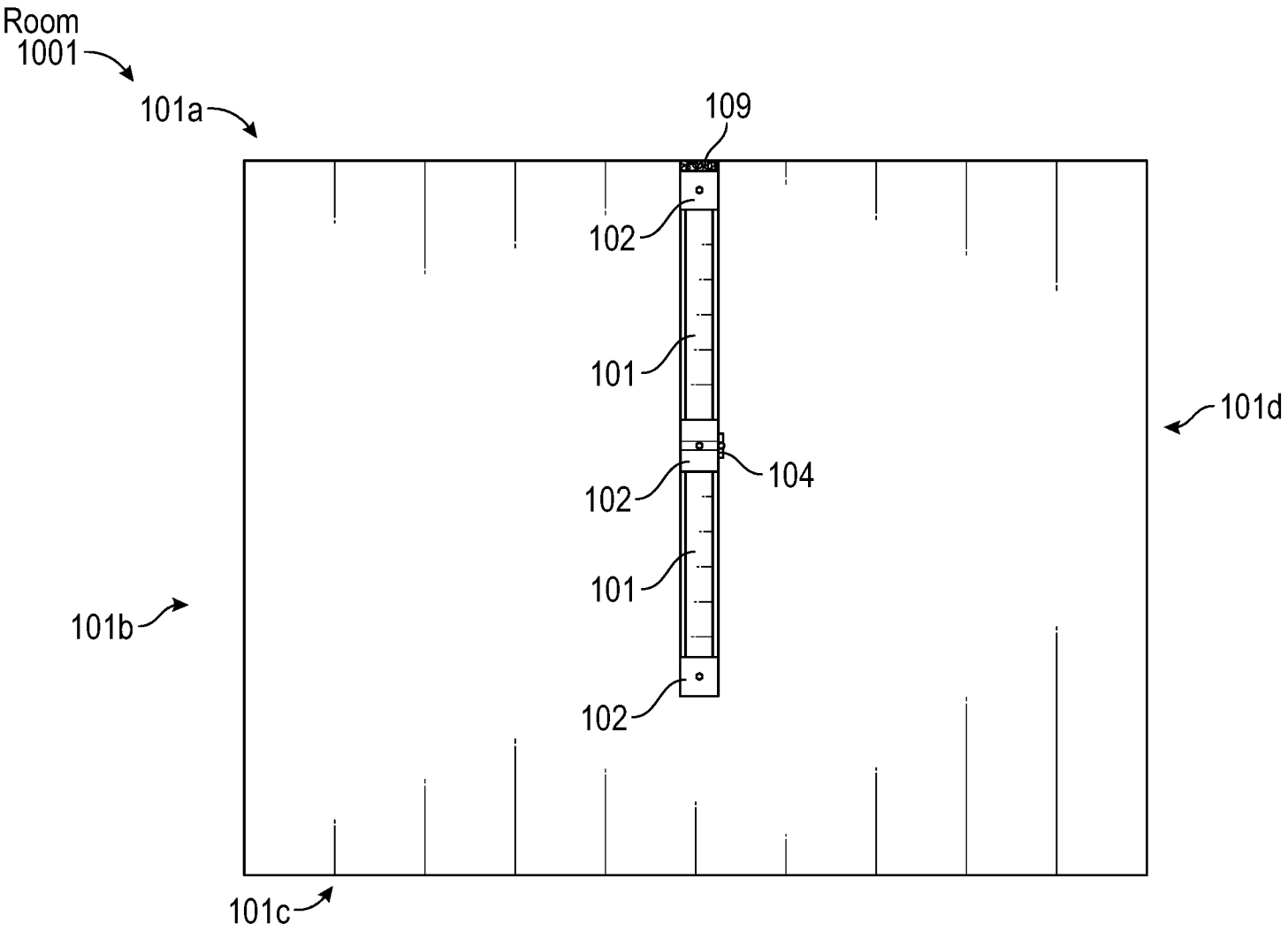
FIG. 2 depicts a room with the straight wall module of FIG. 1 installed. (Top down/plan view)

FIG. 2 depicts a topdown-view of straight module 100 installed in room 1001. One end of straight module 100 abuts permanent wall 101*a*, and another end of straight module 100 abuts permanent wall 101*b*. A foam gasket 109 at the panel and wall creates a tight fit. In this example, straight module 100 comprises doorway 108, where the acoustic panel 101 ends, leaving an open entrance. Doorway 108 can be partially or completely covered with door cover 110 vertical blinds, a shade, or a rectangular piece of cloth, resembling an entryway door similar to a typical bedroom.

Figure 3:
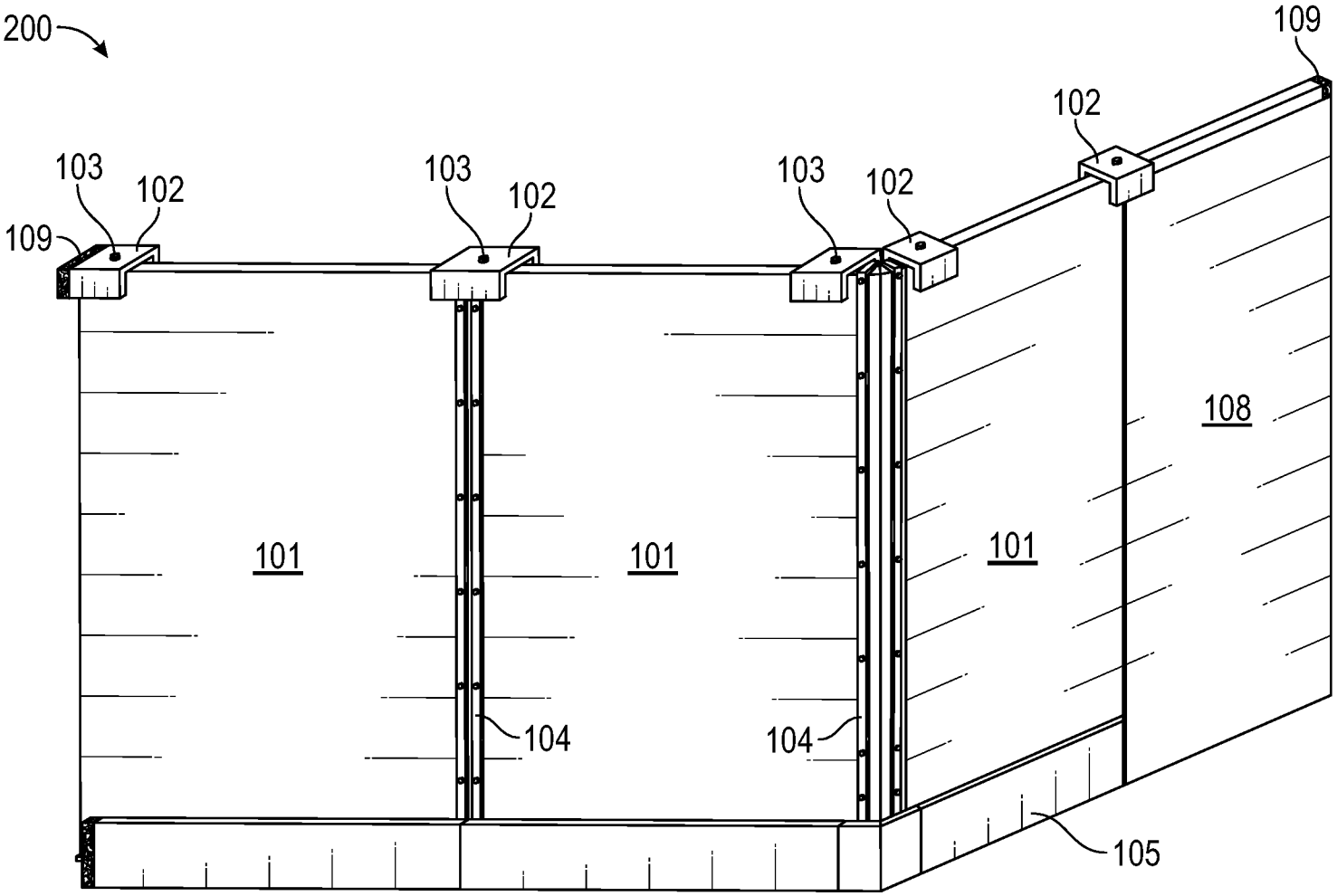
FIG. 3 depicts an embodiment of a corner wall module. (Elevation view)

FIG. 3 depicts corner module 200. Corner module 200 comprises acoustic panels 101, u-channel bars 102, attachment mechanisms 103, hinges 104, adjustable baseboards 105, doorway 108, and foam gasket 109.

Acoustic panels 101, u-channel bars 102, attachment mechanisms 103, hinges 104, adjustable baseboards 105, and doorway 108 are identical to the same components described previously with reference to FIGS. 1-2. The hinge connects the panels at a 90 degree angle.

In this example, door cover 110 fills the gap of doorway 108. Door cover 110 can comprise vertical blinds, a shade, or a rectangular piece of cloth.

Figure 4:
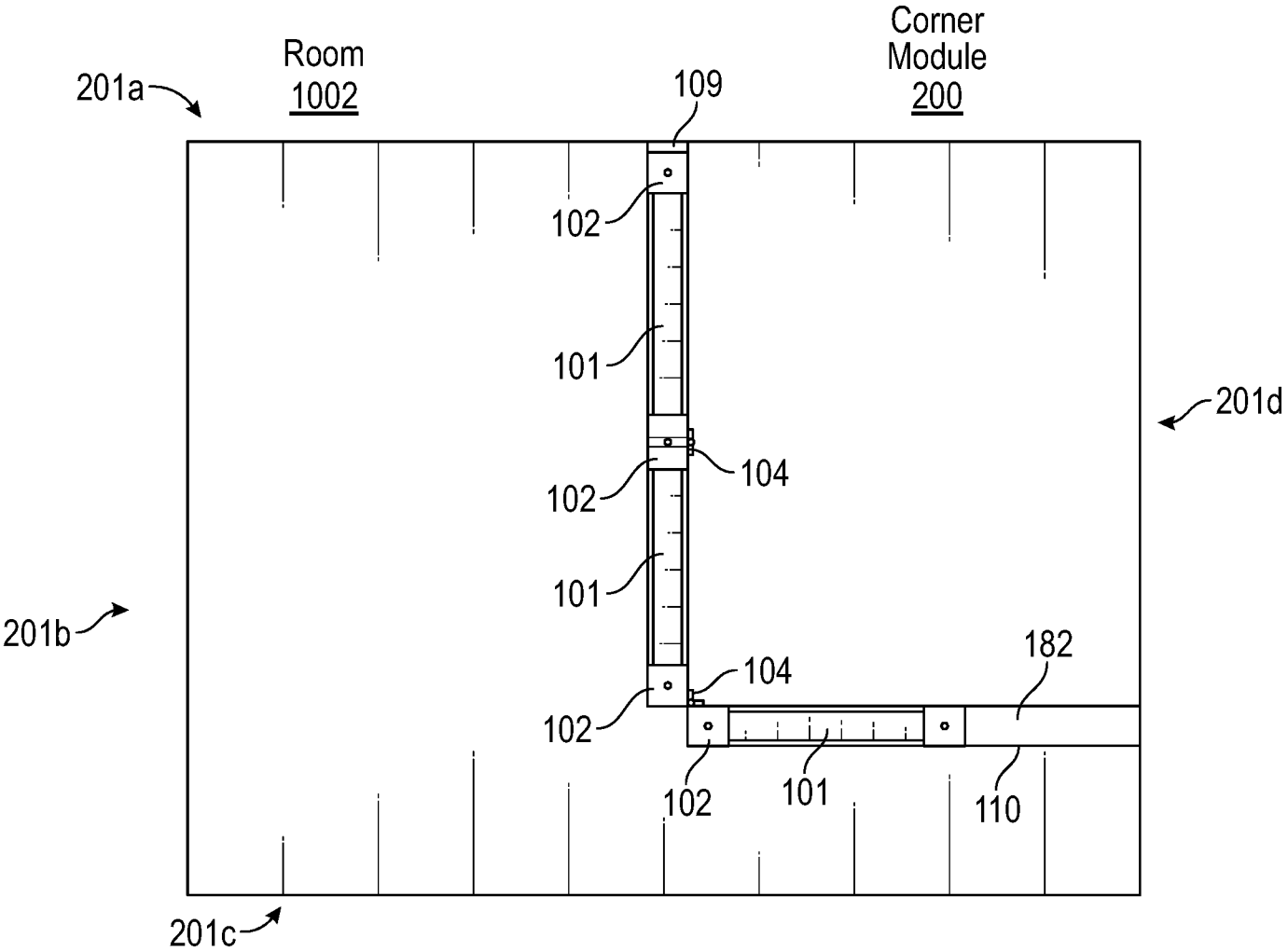
FIG. 4 depicts a room with the corner wall module of FIG. 3 installed. (Top down/plan view)

FIG. 4 depicts corner module 200 installed in room 1002 top-down view. One end of corner module 200 abuts permanent wall 201*a*, and another end of corner module 200 abuts permanent wall 201*d*.

Figure 5A:
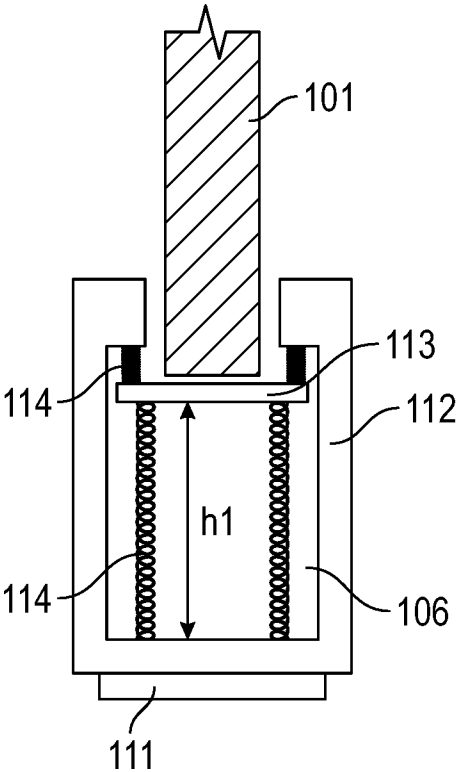
FIGS. 5A, 5B. and 5C depict the adjustable active baseboard used in the straight wall module and corner wall module of FIGS. 1-4.
Figure 5B:
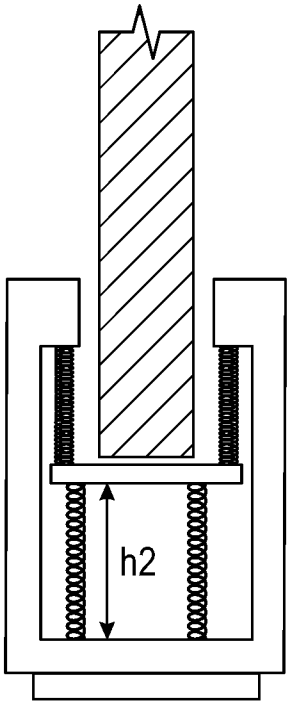
Figure 5C:
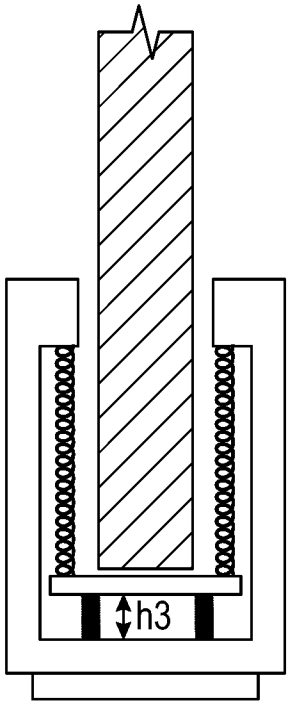

FIGS. 5A, 5B, and 5C depict a cross-section of adjustable baseboard 105. Here, adjustable baseboard 105 comprises baseboard 112 and spring-loaded adjustable level 106. Spring-loaded adjustable level 106 comprises level 113 and springs 114.

Baseboard 112 is constructed from metal, plastic, wood, or another rigid material. Baseboard 112 sits on the floor of the living space. The bottom of the adjustable baseboard has a non-skid material 111 to prevent movement on hard flooring and carpets.

Level 113 is constructed from metal, plastic, wood, or another rigid material.

Springs 114 are constructed from metal or plastic.

Level 113 supports the bottom of acoustic panel 101. It can be appreciated that when a u-channel bar 102 is secured to the ceiling with attachment mechanism 103, springs 114 will push platform 113 upward against the bottom of acoustic panel 101 so that acoustic panel 101 forms a snug fit against the interior top of u-channel bar 102. Baseboard 112 covers the cap in which springs 114 are located and assists in creating a sound-dampening or near soundproof divider between the two portions of the room.

A person of ordinary skill in the art will appreciate that straight module 100 and corner module 200 can be used to create an almost unlimited number of different configurations in the same room.

Figure 6A:
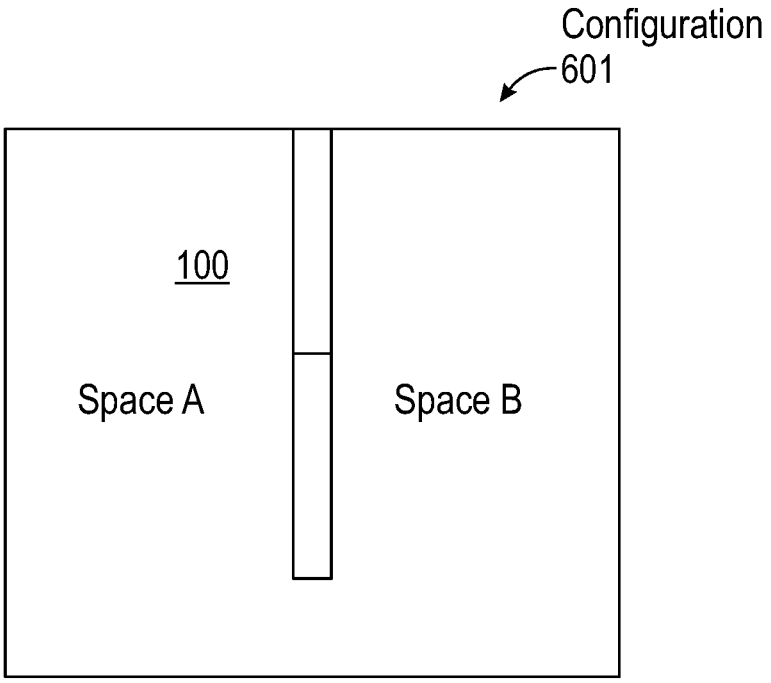
FIGS. 6A, 6B, 6C, 6D, 6E, and 6F depict different configurations of one or more straight wall modules, corner wall modules, and extra panels.

For example, FIG. 6A depicts a first configuration of a room, configuration 601, where one or more straight modules 100 are used to create first space A and second space B.

Figure 6B:
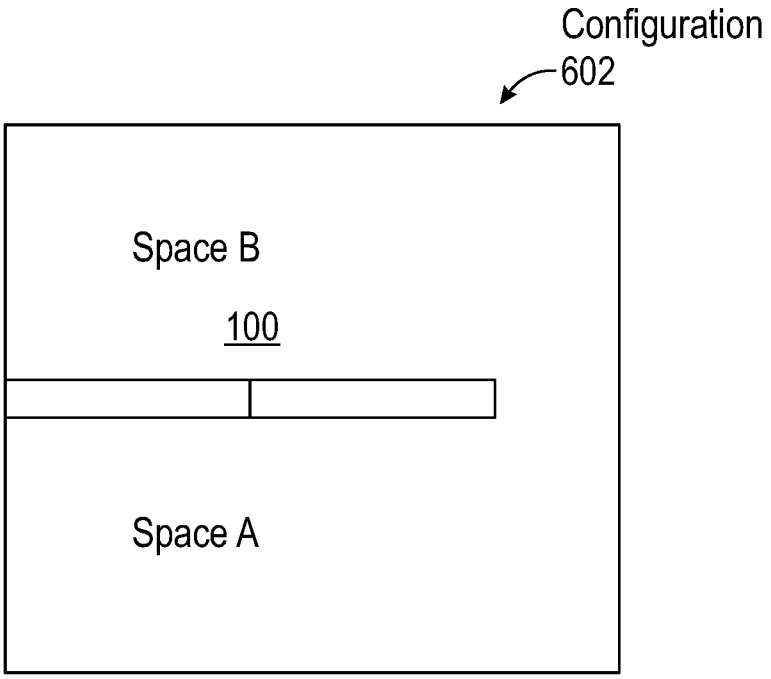

FIG. 6B depicts configuration 602 using one or more straight modules 100 to create space A and space B.

Figure 6C:
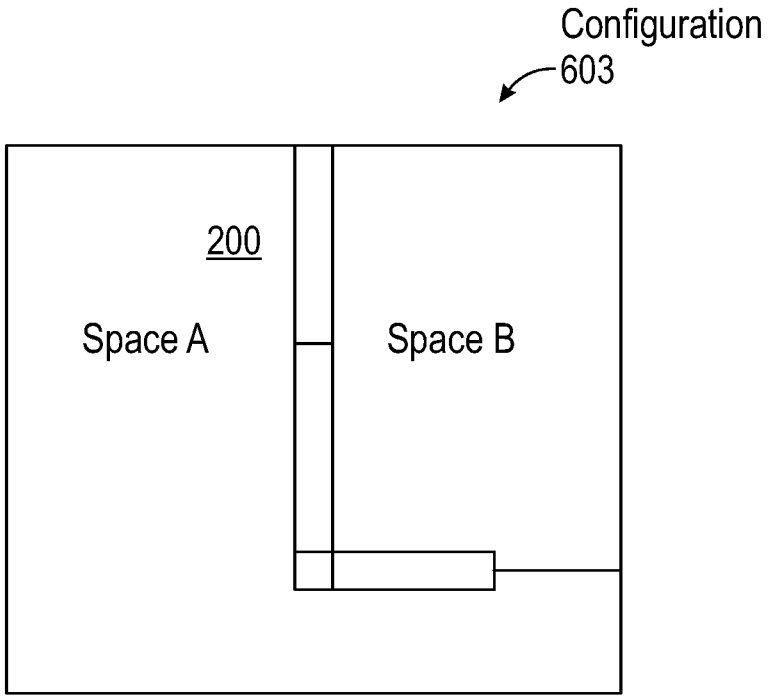

FIG. 6C depicts configuration 603 using corner module 200 and optionally one or more straight modules 100 to create space A and space B.

Figure 6D:
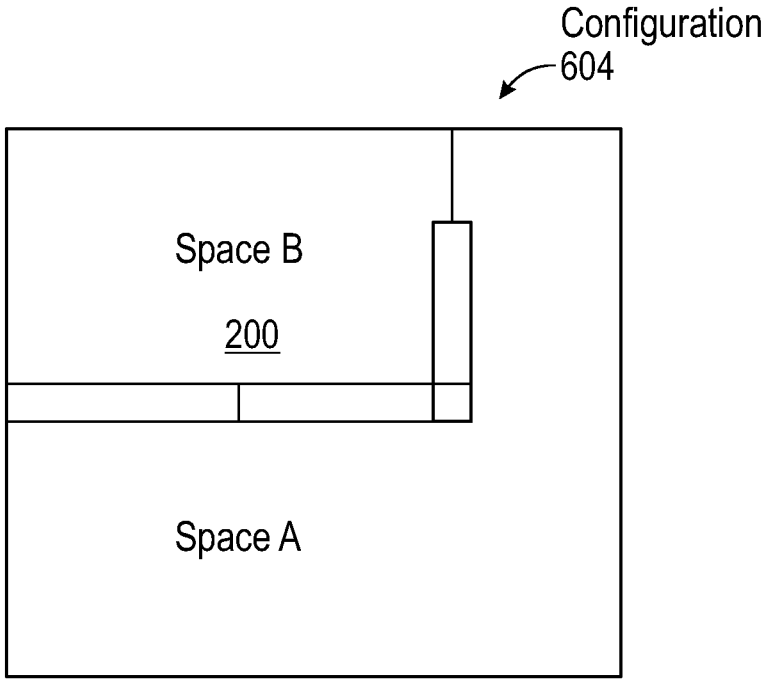

FIG. 6D depicts configuration 604 using corner module 200 and optionally one or more straight modules 100 to create space A and space B.

Figure 6E:
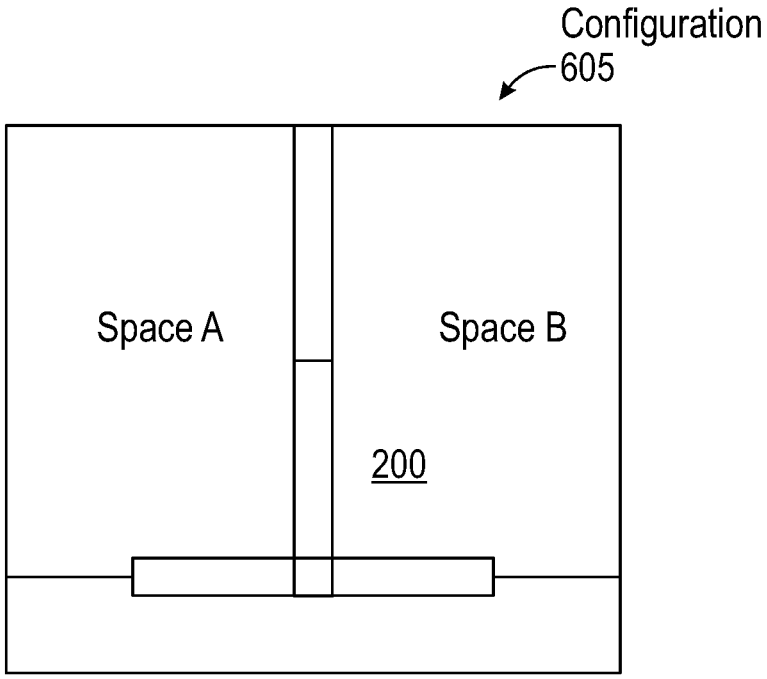

FIG. 6E depicts configuration 605 using corner module 200 and one or more straight modules 100 or panels 101 to create space A and space B.

Figure 6F:
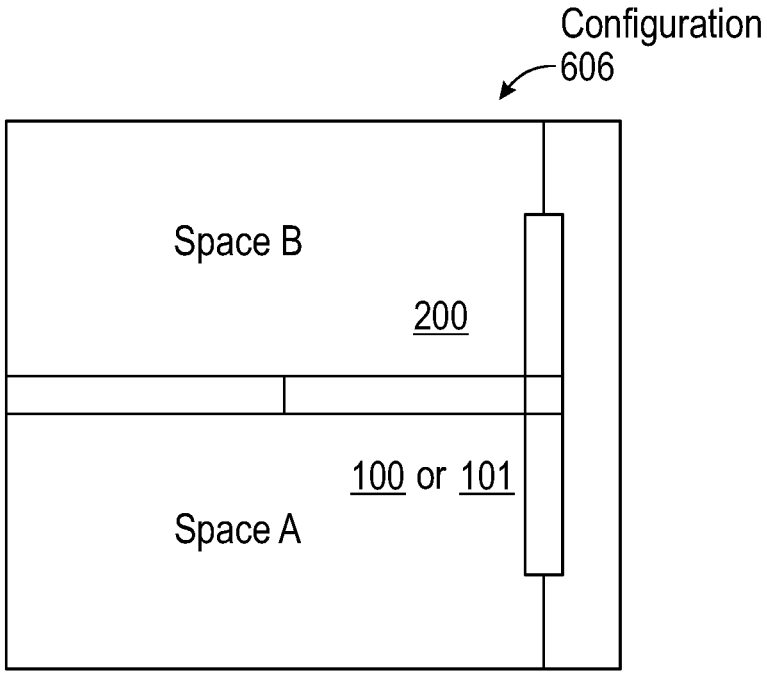

FIG. 6F depicts configuration 606 using corner module 200 and one or more straight modules 100 or panels 101 to create space A and space B. Other configurations are possible using fewer or additional straight modules 100, corner modules 200, and panels 101 depending on the size of the rooms and customer needs.

It should be noted that, as used herein, the terms "over" and "on" both inclusively include "directly on" (no intermediate materials, elements or space disposed therebetween) and "indirectly on" (intermediate materials, elements or space disposed therebetween). Likewise, the term "mounted to" includes "directly mounted to" (no intermediate materials, elements or space disposed there between) and "indirectly mounted to" (intermediate materials, elements or spaced disposed there between), and the term "attached to" includes "directly attached to" (no intermediate materials, elements or space disposed there between) and "indirectly attached to" (intermediate materials, elements or spaced disposed there between).

What is claimed is:

1. A portable module for dividing a room, comprising:
a u-channel bar;
an attachment mechanism for securing the u-channel bar to a ceiling and a wall;
two or more acoustic panels;
one or more hinges, wherein each hinge connects two of the two or more acoustic panels; and
an adjustable baseboard comprising a spring-loaded level in contact with and pushing upward on the two or more acoustic panels and a baseboard piece concealing the spring-loaded level, the spring-loaded level comprising a level, one or more extension springs on a side of the level facing the two or more acoustic panels, and one or more compression springs on an opposite side of the level;
wherein one end of each acoustic panel is nested in the u-channel bar on the ceiling and another end of each acoustic panel is nested in the adjustable baseboard and at least one end of one of the acoustic panels contains a foam gasket to interface with the wall.

2. The portable module of claim 1, wherein the u-channel bar comprises metal.

3. The portable module of claim 1, wherein the u-channel bar comprises plastic.

4. The portable module of claim 1, wherein the two or more acoustic panels comprise polyester or PET (Polyethylene Terephthalate).

5. The portable module of claim 1, wherein the attachment mechanism comprises screws for securing the u-channel bar to a ceiling.

6. The portable module of claim 1, wherein the attachment mechanism comprises nails for securing the u-channel bar to a ceiling.

7. The portable module of claim 1, wherein the attachment mechanism comprises adhesive for securing the u-channel bar to a ceiling.

8. The portable module of claim 1, further comprising a doorway.

9. The portable module of claim 8, further comprising a movable structure in the doorway.

10. A portable module for dividing a room, comprising:
a first u-channel bar;
a second u-channel bar arranged at a right angle to the first u-channel bar;
a first attachment mechanism for securing the first u-channel bar to a ceiling;
a second attachment mechanism for securing the second u-channel bar to the ceiling;
two or more acoustic panels;

one or more hinges, wherein each hinge connects two of the two or more of the acoustic panels;

a first adjustable baseboard comprising a first spring-loaded level in contact with and pushing upward on one or more of the two or more acoustic panels and a first baseboard piece concealing the first spring-loaded level, the first spring-loaded level comprising a level, one or more extension springs on a side of the level facing the one or more of the two or more acoustic panels, and one or more compression springs on an opposite side of the level; and a second adjustable baseboard comprising a second spring-loaded level in contact with and pushing upward on one or more of the two or more acoustic panels and a second baseboard piece concealing the second spring-loaded level, the second spring-loaded level comprising a level, one or more extension springs on a side of the level facing the one or more of the two or more acoustic panels, and one or more compression springs on an opposite side of the level;

wherein one end of each acoustic panel is nested in the first u-channel bar or the second u-channel bar and another end of each acoustic panel is nested in the first adjustable baseboard or the second adjustable baseboard.

11. The portable module of claim 10, wherein the first u-channel bar and the second u-channel bar each comprises metal.

12. The portable module of claim 10, wherein the first u-channel bar and the second u-channel bar each comprises plastic.

13. The portable module of claim 10, wherein each acoustic panel comprises polyester or PET (Polyethylene Terephthalate).

14. The portable module of claim 10, wherein the first attachment mechanism comprises screws for securing the first u-channel bar to the ceiling.

15. The portable module of claim 10, wherein the first attachment mechanism comprises nails for securing the first u-channel bar to the ceiling and a wall.

16. The portable module of claim 10, wherein the first attachment mechanism comprises a gasket for securing the first u-channel bar to the ceiling and a wall.

17. The portable module of claim 10, further comprising a doorway.

18. The portable module of claim 17, further comprising a movable structure in the doorway.

* * * * *